US005947411A

United States Patent [19]

Burke et al.

[11] Patent Number: 5,947,411

[45] Date of Patent: Sep. 7, 1999

[54] METHOD AND APPARATUS FOR AIR FLOTATION

[75] Inventors: David Charles Burke, Portsmouth; Kevin Francis Albert, Barrington, both of N.H.

[73] Assignee: Heidelberger Druckmaschinen AG, Germany

[21] Appl. No.: 09/048,011

[22] Filed: Mar. 26, 1998

[51] Int. Cl.[6] ..... B65H 57/28

[52] U.S. Cl. ..... 242/615.12; 242/615.21

[58] Field of Search ..... 226/97.1, 97.3; 242/615.21, 615.11, 615.12

[56] References Cited

U.S. PATENT DOCUMENTS

| | | | |
|---|---|---|---|
| 2,619,057 | 11/1952 | Ellis, Sr. | 226/97.1 X |
| 3,191,926 | 6/1965 | Ramaika | 242/615.12 |
| 3,488,121 | 1/1970 | Dassonville | 242/615.11 X |
| 4,043,495 | 8/1977 | Sander | 226/97.3 |
| 4,187,968 | 2/1980 | Winterholler et al. | 226/97.3 |
| 4,308,984 | 1/1982 | Vits | 226/97.3 X |
| 4,384,666 | 5/1983 | Koponen et al. | 242/615.12 |
| 4,453,465 | 6/1984 | Heller et al. | 242/615.11 |
| 4,698,914 | 10/1987 | Shu et al. | 226/97.3 |
| 4,726,502 | 2/1988 | Cryderman | 226/97.1 X |
| 4,848,633 | 7/1989 | Hagen et al. | 242/615.12 |
| 4,932,140 | 6/1990 | Lepisto | 242/615.11 X |
| 5,233,919 | 8/1993 | Fecteau et al. | 226/97.3 X |
| 5,797,327 | 8/1998 | Gieser et al. | 242/615.12 X |
| 5,829,166 | 11/1998 | Klas | 242/615.21 X |

FOREIGN PATENT DOCUMENTS 2 283 826 7/1996 United Kingdom .

*Primary Examiner*—Donald P. Walsh
*Assistant Examiner*—Minh Chau Pham
*Attorney, Agent, or Firm*—Burns, Doane, Swecker & Mathis

[57] ABSTRACT

The present invention is directed to introducing air into a web interface of a former board without using holes or internal passageways in the forming bar. Exemplary embodiments achieve an even distribution of air on a surface of the former board which allows a minimum air gap to be achieved between the former board surface and the moving web. As such, damage to the moving web, and wear of the former board are reduced and/or eliminated. Therefore, the former board can be used to introduce a fold into the web without creating significant contact between the former board and the web.

20 Claims, 4 Drawing Sheets

METHOD AND APPARATUS FOR AIR FLOTATION

BACKGROUND OF THE INVENTION

1. Field of the Invention

The present invention relates generally to former boards and, in particular, to former boards for use with a moving web in a printing press.

2. State of the Art

Former boards are used in printing presses to, for example, fold a continuous moving web. Former boards are typically shaped as inverted triangles over which the moving web is transported. A typical former board introduces air into an interface between the web and the former board through radial holes drilled into forming bars over which the web travels.

FIG. 1 shows an exemplary former board 100 having a cylindrical shape. FIG. 2 shows an exemplary former board 200 having a conical shape.

In the FIG. 1 example, a traveling web moves over a roll 102 from a wider portion 104 of the former board 100 toward a lower portion 106 of the former board, at which location the web has been formed into a folded web at or near its previous centerline. Air is introduced through spaced holes 108 along lengths of former board bars 110, 111 to create a cushion of air between side surfaces 112, 114 of the former board and the web. Similarly, the conical former board 200 of FIG. 2 includes holes formed along a length of former board bars 202, 204 to create a cushion of air between the side surfaces and the moving web.

However, the former boards illustrated in FIGS. 1 and 2 do not allow for even pressure distribution in areas between the holes. To the contrary, low pressure areas result which allow the paper to contact the stationary forming bars. This contact results in marking of the web. Another consequence of the web contacting the forming bars is that the bars wear over time.

In addition to low pressure areas being formed at locations on the former board between the air holes, low pressure areas can also occur at the locations of the air holes themselves when the air flow is not properly adjusted. Air flow through individual holes in the forming bars of FIGS. 1 and 2 are not separately controlled. The flow of air through the various holes of the forming bars is collectively controlled using, for example, a metering valve. However, the metering valve provides a very coarse adjustment of a pressure pad established between the web and the former board. These low pressure problems can lead to the air holes being plugged with ink or paper dust, thereby blocking passage of air. This in turn leads to former board wear and damage to the web.

Air flow has been used with commercially available air turn devices, wherein a cushion of air is created to change a web's direction of movement without contacting the web. This type of device is used when the ink applied to the web is still wet, such that any contact between the web and an air turn would damage and likely halt the printing process. The air turn device requires a relatively large air gap between the web and the air turn. However, as those skilled in the art would appreciate, a former board requires a minimum air gap to achieve acceptable product quality.

Attempts to address the foregoing deficiencies in former boards have resulted in repositioning of the air holes on the forming bars and/or increasing the number of air holes. In addition, to minimize former board wear, low friction tape has been applied to the forming bar surface. However, these solutions have not eliminated the foregoing deficiencies, or rendered the former board suitable for introducing a fold into a moving web. Accordingly, it would be desirable to develop a method and apparatus for implementing a former board which addresses the foregoing deficiencies.

SUMMARY OF THE INVENTION

The present invention is directed to introducing air into a web interface of a former board without using holes or internal passageways in the forming bar. Exemplary embodiments achieve an even distribution of air on a surface of the former board which allows a minimum air gap to be achieved between the former board surface and the moving web. As a result, damage to the moving web and wear of the former board are reduced and/or eliminated. Therefore, the former board can be used to introduce a fold into the web without creating significant contact between the former board and the web.

Generally speaking, exemplary embodiments of the present invention relate to an apparatus for transporting a web comprising: a first surface over which said web is transported; and means for establishing a supply of air at an interface between said web and said first surface to levitate said web, said air supply establishing means including at least one slot formed along at least a substantial length of said first surface. Exemplary embodiments of the present invention can be used in conjunction with a printing press which includes, for example, means for applying a web to the first surface over which the web is transported.

BRIEF DESCRIPTION OF THE DRAWINGS

Other objects and advantages of the present invention will become more readily apparent from the following detailed description of preferred embodiments, when read in conjunction with the accompanying drawings, wherein like elements have been designated by like reference numerals, and wherein.

DETAILED DESCRIPTION OF THE PREFERRED EMBODIMENTS

Figure 1:
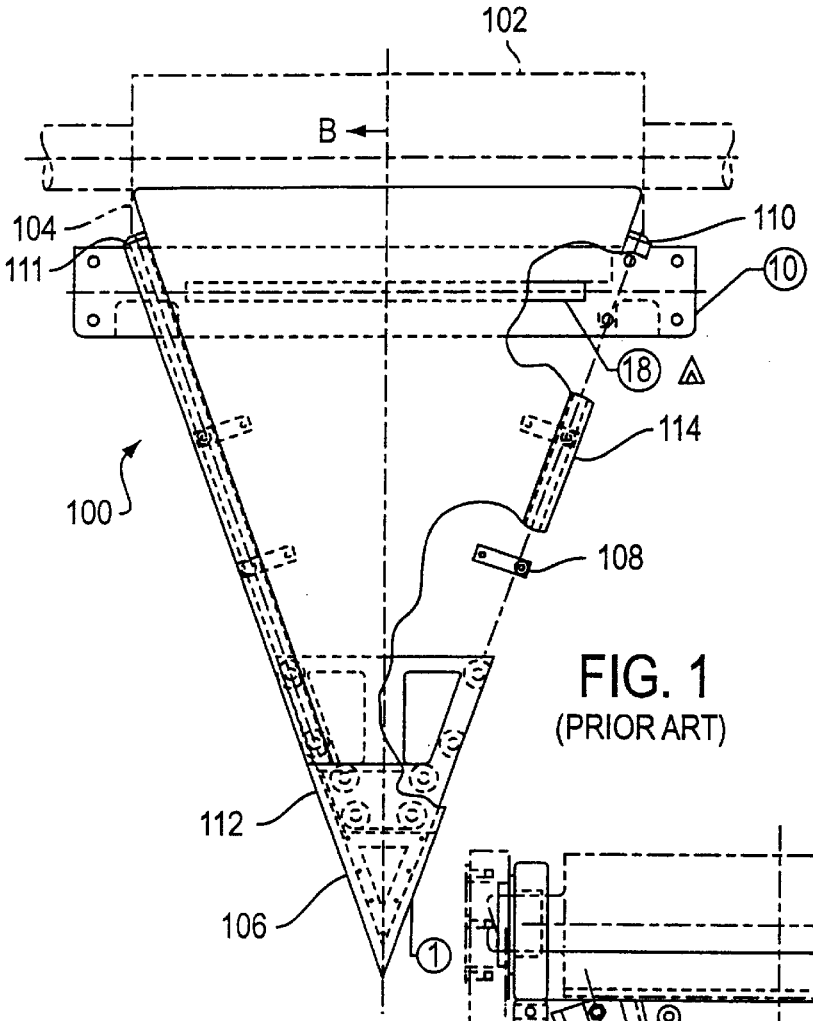
FIG. 1 (PRIOR ART)
FIG. 1 illustrates a conventional former board.
Figure 2:
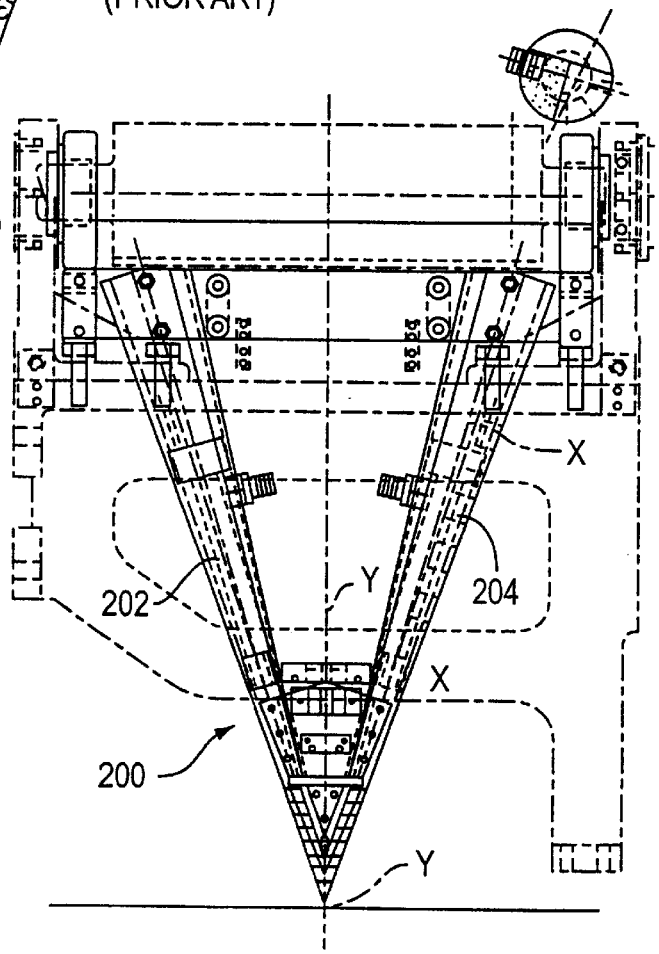
FIG. 2 (PRIOR ART)
FIG. 2 illustrates another conventional former board.
Figure 3:
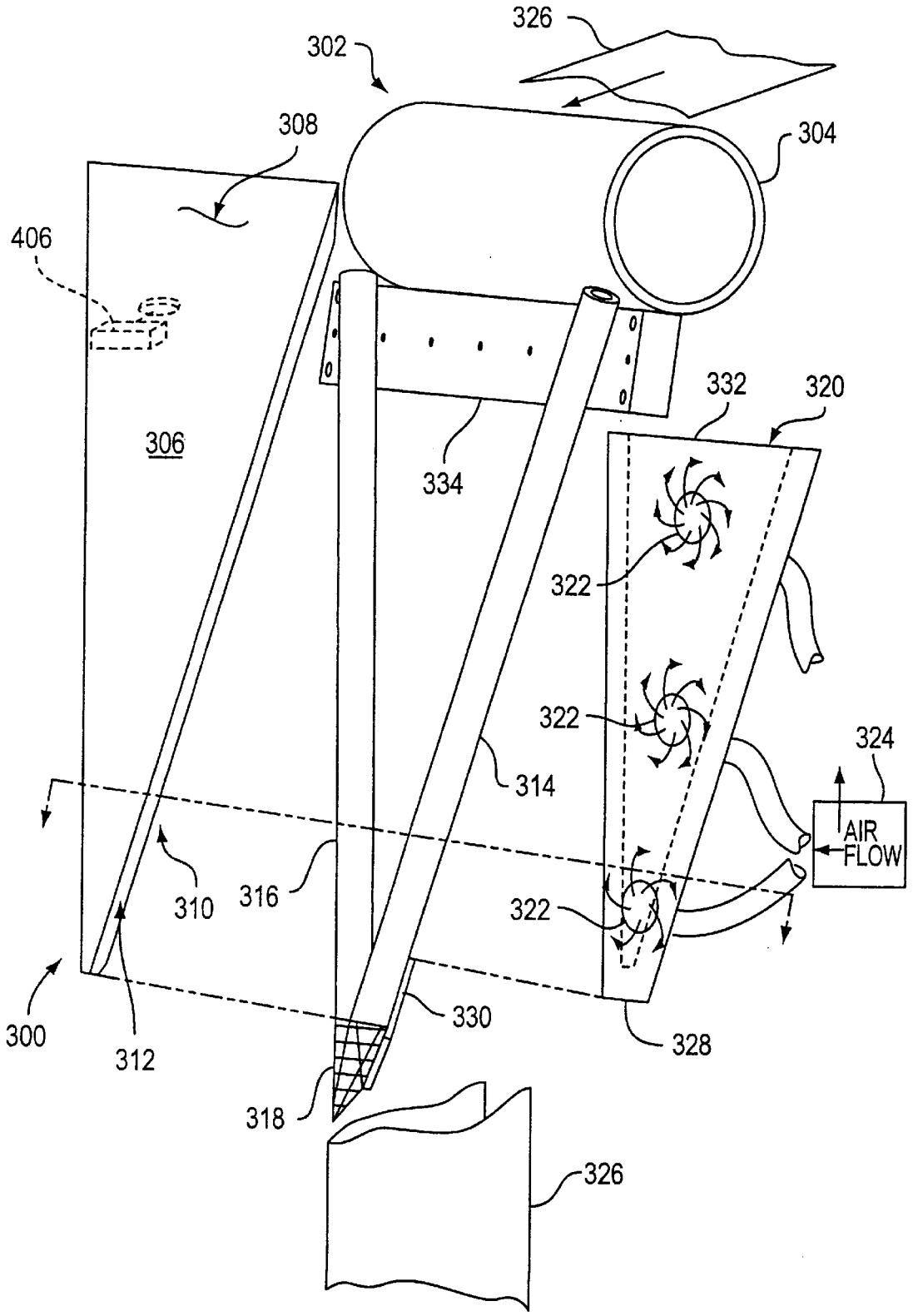
FIG. 3 illustrates an exemplary embodiment of a former board in accordance with the present invention.

FIG. 3 illustrates an exemplary former board 300 as part of a printing press 302. The printing press 302 includes at least one roll 304 for supplying the web over a first surface 306 of a front plate 308 used to make up a portion of the former board.

The former board 300 includes means for establishing a supply of air at an interface between the web and the first surface 306. In an exemplary embodiment, the air supply at this interface is established by at least one slot formed along at least a substantial length of the first surface 306 such that the web travels over the first surface on a cushion of air. As referenced herein, a substantial length refers to a length sufficient to establish an adequate cushion of air between the moving web and the first surface 306, taking into account considerations such as the size (e.g., width), weight and traveling speed of the web. At least one slot 310 is formed between a slot surface 312 and a respective one of two forming bars 314 and 316.

The exemplary embodiment illustrated in FIG. 3 is assembled with the front plate lowered over the forming bars. Use of individual air holes at the peripheral regions of the forming bars (that is, regions of the forming bars which are exposed on either side of the front plate 308) is eliminated. Rather than using individual air holes at peripheral regions in exposed portions of the forming bars, the FIG. 3 embodiment is configured as a sandwich-like structure wherein air exits from at least one slot 310. A similar slot can be formed on an opposite side of the front plate 308, between the front plate 308 and the other forming bar 316.

As such, low pressure areas located between the air holes of conventional former boards, and low pressure areas created at the air holes of conventional former boards, are eliminated. A more even distribution of air can thus be achieved to produce a cushion of air across the interface in accordance with exemplary embodiments of the present invention.

The two forming bars 314, 316 are, in the exemplary FIG. 3 embodiment, configured as two cylindrical bars which are assembled such that the center lines of the cylindrical bars meet at a common point, represented as a former nose 318. Of course, those skilled in the art will appreciate that any number of configurations can be used to implement features of the present invention. For example, rather then using cylindrical forming bars, the bars can be formed with any shape (e.g., conical shapes and so forth).

The front plate 308 is assembled to the former board assembly just beneath a tangent plane of the two forming bars, such that the slots are formed between the front plate 308 and the forming bars 314, 316. A back plate 320 having a lower edge 328 and an upper edge 332 can be mounted to a side of the forming bars 314, 316 which is opposite the side on which the front plate is mounted. In the exemplary FIG. 3 embodiment, the web travels over the front plate without contact, but does not travel over the back plate.

The front and back plates form the sandwich-like structure into which a desired volume of pressurized air can be introduced via one or more air flow inlets 322. The air flow inlets can, for example, be metered if desired in any conventional manner. In the exemplary FIG. 3 embodiment, air flow adjustment into the interior space can be provided using a conventional air flow valve, such as an air flow valve 324 illustrated in FIG. 3. This air fills an interior space defined by the front plate, the back plate and the two forming bars 314, 316. The FIG. 3 embodiment further includes a stationary support plate 330 for holding the lower portion of the forming bars together, and for further establishing the interior space between the front plate, back plate and forming bars. A stationary upper support plate 334 is provided at an upper portion of the former board in similar fashion. The support plate 334 interfaces with the upper edge 332 of the back plate 320. Air from within the interior space can escape only through the slots, such as slot 310 of FIG. 3. As such, this air travels beneath the web moving over the front plate, thereby levitating the web.

In accordance with exemplary embodiments, means can be provided to control air flow through the slots, along the lengths of the slots. Such adjustment of air flow can be provided to take into consideration such factors as variations in web width. In addition, such adjustments can be used to balance the air flow through the slots and thus evenly distribute the air at the web interface. This air flow adjustment can be also provided by controlling a width of the slots using one or more slot flow control seals 406.

In accordance with exemplary embodiments, the ability to provide adequate levitation of the web, and to control air pressure through the slots, permits the former board to be used in applications beyond merely redirecting and/or guiding the web. For example, such a configuration can be used to introduce a fold to the web, as illustrated by the folded web 326 of FIG. 3. Such a feature can be achieved without causing excessive wear to the former board or clogging the air supply to the interface between the moving web and the front plate (i.e., without clogging the slots, such as slot 310).

Figure 4:
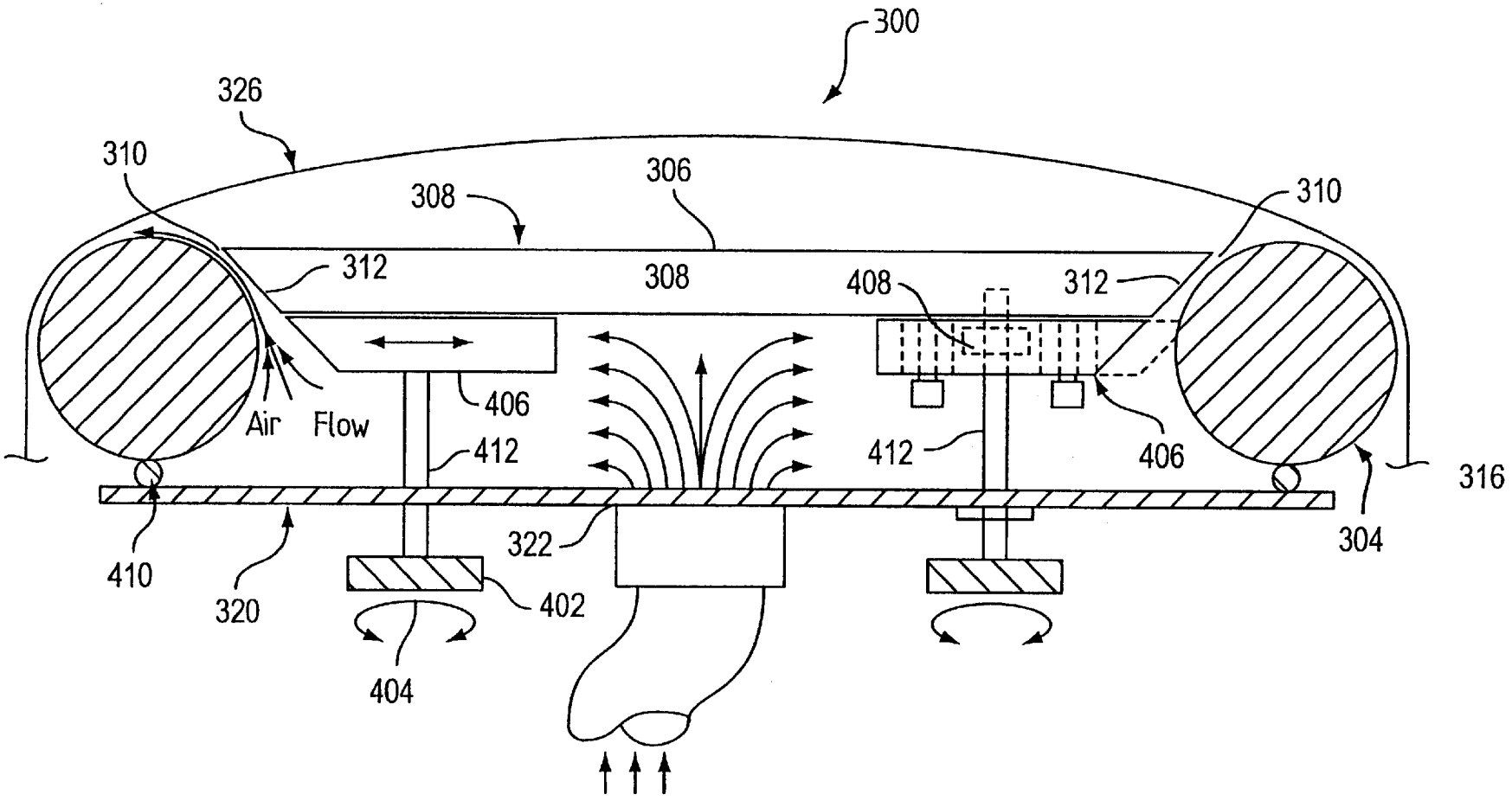
FIG. 4 illustrates a partial cross-sectional view of the FIG. 3 former board.

FIG. 4 shows a partial cross-sectional view of the FIG. 3 former board. As can be seen with respect to FIG. 4, the air supply used to establish an air gap between the moving web and the surface 306 can be adjusted by altering the configuration of the slots 310. For example, the slots 310 can be widened or narrowed to accommodate any web width. As can be seen in FIG. 4, air flow is controlled so that air only escapes from the interior space of the former board by exiting beneath the web as it passes over the front plate 308. The air supply through the slots is metered by varying an effective width of the slots 310 along their length.

In the FIG. 4 embodiment, at least one adjustment knob 402, rotatable about an axis 404, can be rotated in a screw-like manner to laterally shift a slot flow control seal 406. The slot flow control seal 406 can be shifted in response to rotational movement of a cam eccentric 408 that is rotationally displaced by the knob 402. A slot flow control seal which has been shifted to narrow the slot 310 is illustrated in the right hand portion of FIG. 4 with dashed lines. As mentioned previously, such metering can be used to achieve a desired, and consistent levitation of the web above the first surface 306.

The cross-sectional view of FIG. 4 also illustrates use of an air seal 410 between the back plate and the forming bars 314, 316. Similar air seals can be used between the lower edge 328 of the back plate and the support plate 330 used to hold the lower portion of the forming bars together in FIG. 3. In addition, an air seal can be located between the upper edge 332 of the back plate and the upper support plate 334.

Referring again to FIG. 4, shafts 412 of the adjustment knobs 402 can be used to maintain the front plate 308 in spaced relation to the forming bars 314, 316 and to establish the slots 310. As those skilled in the art will appreciate, although a lateral movement of the slot flow control seals is illustrated in the exemplary FIG. 4 embodiment to provide air flow control, vertical movement of the front plate 308 can also be used to control air supply to the interface between the first surface 306 and the web 326. Further, those skilled in the art will appreciate that while the slots 310 are illustrated in FIG. 3 as being continuous along a substantial length of the former board, multiple slots of any desired length can be included along these lengths in alternate embodiments. Additional slots can also be provided in the first plate 308, in parallel with the slots 310.

Figure 5A:
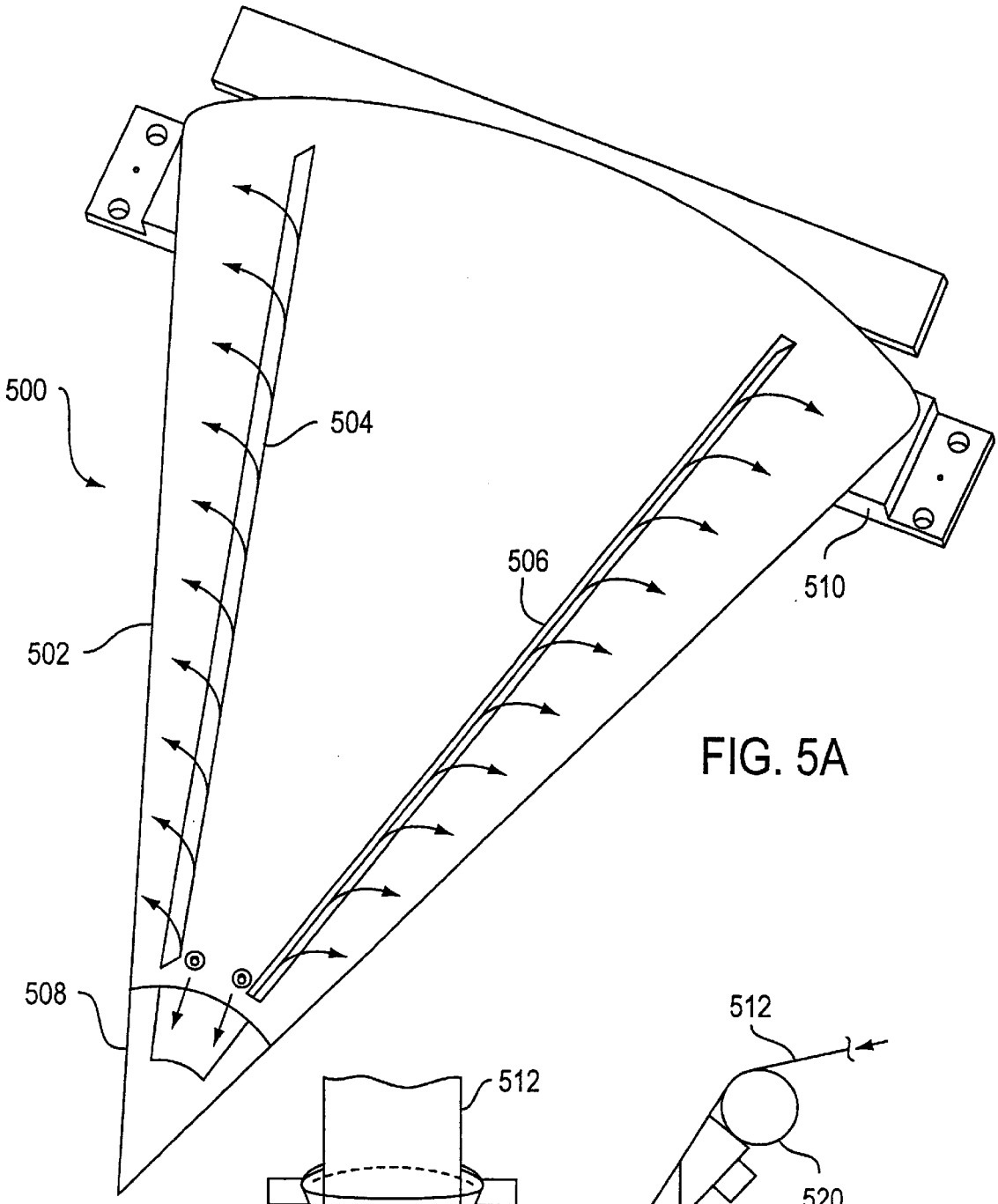
FIGS. 5A–5C illustrate an alternate exemplary embodiment of a former board in accordance with the present invention.
Figure 5B:
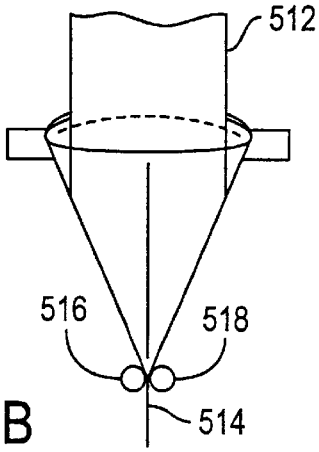
Figure 5C:
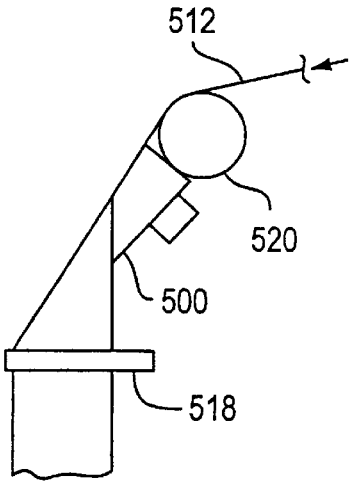

FIGS. 5A–5C illustrate an alternate exemplary embodiment of a former board 500 in accordance with the present invention. In the FIG. 5A embodiment, the use of forming bars and a front plate to establish the slots 310 has been replaced with a single former plate 502 having conically shaped sidewalls. The former plate 502 represents a first surface used to establish an interface between a moving web and the former board The slots 504 and 506 extend along a substantial length of the former plate 502. As with the FIG. 3 embodiment, a former nose 508 of the former board can be removably attached to the former board support (e.g., by any fastening means, such as screws and so forth) such that this nose, which is used to introduce a fold to the moving web, can be removed after excessive use. An upper portion of the former board can be mounted to a stationary support 510.

Those skilled in the art will appreciate that in the exemplary FIG. 5A embodiment, air flow control can be provided in a manner similar to that described with respect to the FIG. 3 embodiment. That is, air flow adjustment to an interior space between the former plate 502 and a back plate (not shown in FIG. 5) can be provided. Air flow adjustment can also be provided by controlling a width of the slots in the former plate 502 using one or more slot flow control seals 406. A sealing of the interior space can be provided in a manner similar to that described with respect to FIG. 3.

FIG. 5B illustrates a front view of the FIG. 5A former board, with a moving web 512 being transported in a downward, vertical direction. Edges of the web are pulled down over the conical sides of the former board 502 to establish a fold 514 in the moving web. This fold can be established by rolls 516, 518 of the printing press cooperating with the taped, conically shaped sidewalls of the former plate.

FIG. 5C illustrates a side view of the FIG. 5B operation. As seen therein, the web 512 travels down over a roll 520 of the printing press. The web continues over the former board 500, and is folded as it exits the downward, reduced width portion of the former board.

Those skilled in the art will appreciate that the exemplary embodiments illustrated in FIGS. 3–5 are by way of example only, and that numerous variations exist. For example, slots illustrated in these Figures can be reconfigured in any manner desired to achieve the even flow distribution of air at the interface between the web and the former board surface over which the web travels. In addition, the slot flow control seals 406 can be reconfigured in alternate embodiments. For example, the slot flow control seals can be configured such that they extend along the length of the slots. Alternately, any number of individual flow control seals can be placed along the length of the slots in either abutting arrangement or in spaced arrangement, depending on an amount of flow control desired by the user.

It will be appreciated by those skilled in the art that the present invention can be embodied in other specific forms without departing from the spirit of the essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Apparatus for transporting a web in a web fed rotary printing press, comprising:

a former board which comprises a first surface over which said web is to be transported, wherein said former board includes a first plate and a second plate mounted opposite one another; and means for establishing a supply of air at an interface between said web and said first surface to levitate said web, said air supply establishing means including at least one slot formed along at least a substantial length of said first surface.

2. Apparatus according to claim 1, wherein said former board further includes:

at least two forming bars for folding said web; and said first plate and said second plate being mounted to opposite sides of said two forming bars, said at least one slot being formed between said first plate and at least one of said two forming bars.

3. Apparatus according to claim 2, wherein said former board further includes:

at least one additional slot formed between the other of said at least two forming bars and said first plate for supplying air to said interface.

4. Apparatus according to claim 3, further comprising:

means for supplying a metered air flow to an interior space of said apparatus, said interior space being defined by said first, said second plate and said at least said two forming bars.

5. Apparatus according to claim 4, further comprising:

means for adjusting a width of said at least one slot to control air flow supplied to said interface.

6. Apparatus according to claim 5, wherein said width adjusting means further includes:

at least one movable flow control seal; and means for adjusting a position of said at least one flow control seal within said at least one slot.

7. Apparatus according to claim 6, wherein said means for adjusting a position of said at least one flow control seal further includes:

at least one cam operably connected with said at least one flow control seal; and a rotatable knob for adjusting a position of said cam.

8. Apparatus according to claim 5, further comprising:

means for supplying a metered amount of air flow to said interior space via at least one air flow inlet to said second plate.

9. Apparatus according to claim 1, wherein said first plate includes said at least one slot formed therein along a length of the plate in a direction of travel of said web.

10. Apparatus according to claim 9, wherein said plate includes multiple slots formed therein.

11. A web-fed rotary printing press comprising:

means for supplying a web to a first surface of a former board over which said web is to be transported, wherein said former board includes a first plate and a second plate mounted opposite one another; and means for establishing a supply of air at an interface between said web and said first surface of said former board to levitate said web, said air supply establishing means including at least one slot formed along at least a substantial length of said first surface.

12. Apparatus according to claim 11, wherein said former board further includes:

at least two forming bars for folding said web; and first plate and said second plate being mounted to opposite sides of said two forming bars, said at least one slot being formed between said first plate and at least one of said two forming bars.

13. Apparatus according to claim 12, wherein said former board further includes:

at least one additional slot formed between the other of said at least two forming bars and said first plate for supplying air to said interface.

14. Apparatus according to claim 13, further comprising:

means for supplying a metered air flow to an interior space of said apparatus, said interior space being defined by said first plate, said second plate and said at least said two forming bars.

15. Apparatus according to claim 14, further comprising:

means for adjusting a width of said at least one slot to control air flow supplied to said interface.

16. Apparatus according to claim 15, wherein said width adjusting means further includes:

at least one movable flow control seal; and means for adjusting a position of said at least one flow control seal within said at least one slot.

17. Apparatus according to claim 16, wherein said means for adjusting a position of said at least one flow control seal further includes:

at least one cam operably connected with said at least one flow control seal; and a rotatable knob for adjusting a position of said cam.

18. Apparatus according to claim 11, wherein said first plate includes said at least one slot formed therein along a length of the plate in a direction of travel of said web.

19. Apparatus according to claim 18, wherein said plate includes multiple slots formed therein.

20. A method for transporting a web in a printing press, comprising the steps of:

supplying the web to a former board having a first surface over which the web is transported on a cushion of air, wherein said former board includes a first plate and a second plate mounted opposite one another; and establishing a supply of air at an interface between said web and said first surface of said former board by using at least one slot formed along at least a substantial length of said first surface to produce an even distribution of air pressure over said interface and to levitate said web.

* * * * *